US007507300B2

(12) United States Patent
Boykin et al.

(10) Patent No.: US 7,507,300 B2
(45) Date of Patent: Mar. 24, 2009

(54) METHOD AND APPARATUS FOR CLEANING A PHOTOACTIVE AND/OR HYDROPHILIC SURFACE

(75) Inventors: Cheri T. Boykin, Wexford, PA (US); Caroline S. Harris, Pittsburgh, PA (US); Cory D. Steffek, Pittsburgh, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 236 days.

(21) Appl. No.: 11/604,646

(22) Filed: Nov. 27, 2006

(65) Prior Publication Data

US 2007/0137673 A1 Jun. 21, 2007

Related U.S. Application Data

(63) Continuation of application No. 10/657,313, filed on Sep. 8, 2003, now abandoned.

(60) Provisional application No. 60/409,397, filed on Sep. 10, 2002, provisional application No. 60/419,903, filed on Oct. 21, 2002.

(51) Int. Cl.
*B08B 3/04* (2006.01)
*B08B 3/06* (2006.01)

(52) U.S. Cl. ..... 134/26; 134/28; 134/2; 134/3

(58) Field of Classification Search ..... 134/2, 134/3, 26, 28; 510/108, 467, 480, 488, 493
See application file for complete search history.

(56) References Cited

U.S. PATENT DOCUMENTS 5,645,737 A * 7/1997 Robinson et al. ..... 438/692
6,423,148 B1 * 7/2002 Aoki ..... 134/3
6,869,028 B2 * 3/2005 Bartsch et al. ..... 239/315

FOREIGN PATENT DOCUMENTS

WO WO-97/48927 * 12/1997

* cited by examiner

*Primary Examiner*—Michael Barr
*Assistant Examiner*—Saeed T Chaudhry
(74) *Attorney, Agent, or Firm*—Andrew C. Siminerio

(57) ABSTRACT

A method of cleaning a photoactive and/or hydrophilic surface includes contacting the surface with conditioned water and optionally a cleaning agent solution. A device for cleaning a photoactive and/or hydrophilic surface includes a housing having an inlet and an outlet, a first chamber and an optional second chamber located in the housing, a flow passage extending through the housing between the inlet and the outlet, and a selector valve configured to selectively place the flow passage in flow communication with the first chamber, the optional second chamber, neither chamber, or both chambers. In one embodiment, the first chamber includes an ion exchange bed and the second chamber includes at least one cleaning agent.

13 Claims, 1 Drawing Sheet

METHOD AND APPARATUS FOR CLEANING A PHOTOACTIVE AND/OR HYDROPHILIC SURFACE

CROSS REFERENCE TO RELATED APPLICATIONS

This application is a continuation of U.S. application Ser. No. 10/657,313, filed on Sep. 8, 2003, which claims the benefits of U.S. Provisional Application Ser. No. 60/409,397 filed Sep. 10, 2002 and 60/417,903 filed Oct. 11, 2002.

BACKGROUND OF THE INVENTION

1. Field of the Invention

The present invention relates generally to methods and apparatus for cleaning substrates (e.g., coated and/or uncoated substrates) and, in one embodiment, to a method and apparatus for cleaning a glass substrate having a photoactive and/or hydrophilic surface.

2. Technical Considerations

For many substrates, e.g., glass substrates such as architectural windows, automotive transparencies, and aircraft windows, it is desirable for good visibility that the surface of the substrate have minimal accumulation of surface contaminants, such as common organic and inorganic surface contaminants, for as long a duration as possible. In order to reduce the accumulation of organic surface contaminants, a hydrophilic and/or photoactive ("PA") coating can be deposited on the glass surface. The terms "photoactive" or "photoactively" refer to the photogeneration of an electron-hole pair when illuminated by activating radiation in a particular frequency range. The activating radiation can be in the ultraviolet ("UV") or visible ranges of the electromagnetic spectrum. By "ultraviolet range" is meant electromagnetic radiation in the range of 280 nanometers to less than 395 nanometers. By "visible range" is meant electromagnetic radiation in the range of 395 nm to 800 nm. Above a certain minimum thickness, these PA coatings are typically photocatalytic ("PC"). By "photocatalytic" is meant a surface, such as a coating, having some degree of self-cleaning properties. By "self-cleaning" is meant a surface or coating which upon exposure to electromagnetic radiation in the photoabsorption band of the material interacts with organic contaminants on the surface to degrade or decompose at least some of the organic contaminants. As the coating thickness decreases, photocatalytic activity can be difficult to measure. In addition to their self-cleaning properties, these PC coatings can also be hydrophilic, e.g., water wetting with a contact angle with water of generally less than 20 degrees. The hydrophilicity of the PC coatings helps reduce fogging, i.e., the accumulation of water droplets on the coating, which fogging can decrease visible light transmission and visibility through the coated substrate.

While these photoactive coatings can provide a glass substrate, such as a window, with improved low maintenance properties, such as some self-cleaning properties with regard to organic contaminants, they do not generally decompose inorganic contaminants. Therefore, since typical household water contains dissolved minerals and inorganic ions (such as magnesium, calcium, iron, and/or sodium ions and compounds), when household water is used to clean a substrate having a photoactive coating, upon evaporation of the water the dissolved minerals and inorganic materials can deposit on the coating surface, typically as inorganic salts. These inorganic salts can form as crystals. In the event that hydrophobic areas or spots form on the surface, these crystals can accumulate on the hydrophobic spots. Conventional photoactive, e.g., photocatalytic, coatings are ineffective in breaking down these inorganic solids. A problem with these inorganic solids is that as they accumulate, they can decrease visible light transmission through the window and/or make the window appear hazy. Additionally, these inorganic solids can form visible streaks or patterns on the window. This streaking and patterning is believed due to the uneven distribution of the minerals and inorganic salts that arises from the sheeting action of the photoactive, e.g., hydrophilic, surface. The overall effect of these inorganic materials is to make the window appear hazy or streaky over time. Additionally, silicates in the water used to clean the window can permanently bond to exposed areas of the glass surface and can also make the window appear hazy.

Therefore, it would be advantageous to provide a method and/or device to clean a substrate, such as a glass surface having a photoactive and/or hydrophilic surface or coating, which reduce or eliminate at least some of the drawbacks described above.

SUMMARY OF THE INVENTION

A method of cleaning a surface, such as but not limited to a photoactive and/or hydrophilic surface, comprises the steps of contacting the surface with conditioned water (defined below) and optionally drying the surface, such as by wiping with a dry cloth or paper towel or by simply allowing moisture on the surface to evaporate under ambient conditions. In one exemplary method, the surface can be contacted with a complexing agent solution, such as an aqueous complexing agent solution, and subsequently contacted with conditioned water.

A device for cleaning a surface, such as a photoactive and/or hydrophilic surface, comprises a housing having an inlet and an outlet. A first chamber and optionally at least one other (second) chamber can be located in the housing. A flow passage extends through the housing between the inlet and the outlet. A selector valve can be configured to selectively place the flow passage in flow communication with the first chamber, the optional at least one other chamber, none of the chambers, selected one or more of the chambers, or all of the chambers. In one embodiment, the first chamber can include an ion exchange bed and the at least one other chamber can include at least one cleaning agent.

A cleaning solution comprises conditioned water and at least one cleaning agent. The cleaning agent can include at least one complexing agent and/or at least one surfactant.

DESCRIPTION OF THE INVENTION

Figure 1:
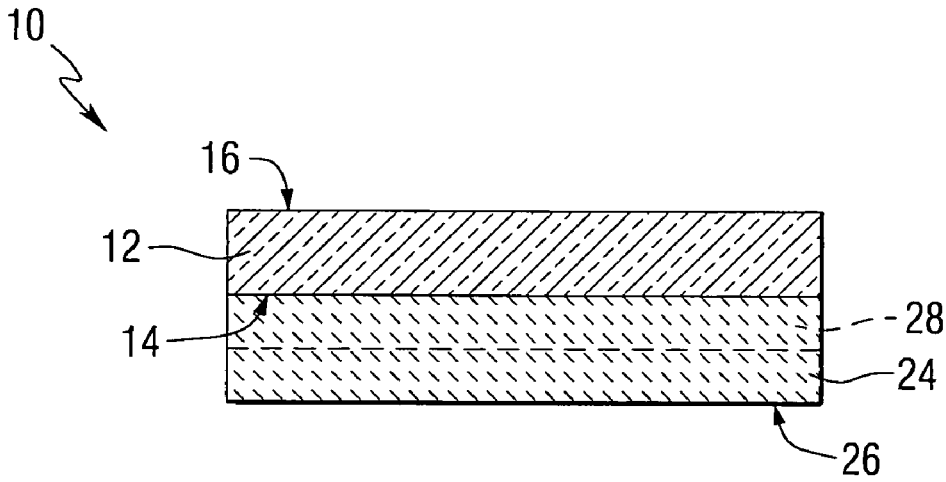
FIG. 1 is a side view (not to scale) of a portion of an exemplary substrate having a photoactive coating deposited thereon which can be cleaned in accordance with the invention.

As used herein, spatial or directional terms, such as "inner", "outer", "above", "below", "top", "bottom", and the like, relate to the invention as it is shown in the drawing figures. However, it is to be understood that the invention can assume various alternative orientations and, accordingly, such terms are not to be considered as limiting. Further, all numbers expressing dimensions, physical characteristics, processing parameters, quantities of ingredients, reaction conditions, and the like, used in the specification and claims are to be understood as being modified in all instances by the term "about". Accordingly, unless indicated to the contrary, the numerical values set forth in the following specification and claims are approximations that can vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10. Further, as used herein, the terms "deposited over" or "provided over" mean deposited or provided on but not necessarily in contact with the surface. For example, a coating "deposited over" a substrate does not preclude the presence of one or more other coating films of the same or different composition located between the deposited coating and the substrate. Additionally, all percentages disclosed herein are "by weight" unless indicated to the contrary. All root mean square (RMS) surface roughness values herein are those determinable by atomic force microscopy by measurement of the root mean square roughness over an area of one square micrometer. All references referred to herein are to be understood to be incorporated in their entirety.

To describe the general principles of the invention, an exemplary article having a photoactive coating will first be described and then an exemplary method and device for cleaning the article in accordance with the invention will be described. In the following discussion, the article will be referred to as an architectural window. However, it is to be understood that the cleaning method and/or device of the invention are not limited to use with coated surfaces and/or architectural windows but can be practiced on any desired substrate, such as but not limited to coated or uncoated tile substrates, ceramic substrates, and glass substrates such as but not limited to insulated glass units, and transparencies for air, sea-going, or land vehicles (such as automotive windshields, back lights, sidelights, moon roofs, etc.), just to name a few. Additionally, the invention is not limited to use with articles having photoactive coatings. For example, the article could have a hydrophilic surface or coating that is not necessarily photoactive. As an additional non-limiting example, the article could be non-coated but could have a hydrophilic surface, such as but not limited to a cleaned or polished glass surface.

Referring to FIG. 1, there is shown a portion of an article 10 having a substrate 12 with a first major surface 14 and a second major surface 16. The substrate 12 is not limiting to the invention and can be of any desired material having any desired characteristics, such as opaque, translucent, or transparent to visible light. By "transparent" is meant having a transmittance through the substrate of greater than 0% up to 100%. By "visible light" is meant electromagnetic energy in the range of 395 nanometers (nm) to 800 nm. Alternatively, the substrate can be translucent or opaque. By "translucent" is meant allowing electromagnetic energy (e.g., visible light) to pass through the substrate but diffusing this energy such that objects on the side of the substrate opposite to the viewer are not clearly visible. By "opaque" is meant having a visible light transmittance of 0%. Examples of suitable substrates include, but are not limited to, plastic substrates (such as acrylic polymers, such as polyacrylates, polyalkylmethacrylates, such as polymethylmethacrylates, polyethylmethacrylates, polypropylmethacrylates, and the like, polyurethanes, polycarbonates, and polyalkylterephthalates, such as polyethyleneterephthalate (PET), polypropyleneterephthalates, polybutyleneterephthalates, and the like, or copolymers of any monomers for preparing these, or mixtures thereof); metal substrates; ceramic substrates; tile substrates; glass substrates; or mixtures or combinations thereof. For example, the substrate can be conventional untinted soda-lime-silica glass, i.e., "clear glass", or can be tinted or otherwise colored glass, borosilicate glass, leaded glass, tempered, untempered, annealed, or heat-strengthened glass. The glass may be of any type, such as conventional float glass or flat glass, and may be of any composition having any optical properties, e.g., any value of visible transmission, ultraviolet transmission, infrared transmission, and/or total solar energy transmission. Types of glass suitable for the practice of the invention are described, for example but not to be considered as limiting, in U.S. Pat. Nos. 4,746,347; 4,792,536; 5,240,886; 5,385,872; and 5,393,593. Additionally, the glass can be a coated glass, such as ACTIV™ glass commercially available from Pilkington plc Corporation of Great Britain.

One or both of the surfaces 14, 16 of the substrate 12 can be hydrophilic, i.e., water wetting. Additionally or alternatively, one or more of the surfaces 14, 16 can be photoactive, such as photocatalytic and/or photoactively hydrophilic. For example, a coating 24 can be deposited over all or at least a portion of the substrate 12, e.g., over all or a portion of the major surface 14 and/or the major surface 16. In one embodiment, the coating 24 can be a material that is hydrophilic and/or photoactive (such as photocatalytic and/or photoactively hydrophilic). By "photoactively hydrophilic" or "photoactive hydrophilicity" is meant a coating on which the contact angle of a water droplet decreases with time as a result of exposure of the coating to electromagnetic radiation in the photoabsorption band of the material. By "photoabsorption band" is meant the range of electromagnetic radiation absorbed by a material to render the material photoactive. For example, the contact angle can decrease to a value less than 15°, such as less than 10°, and can become superhydrophilic, e.g., decrease to less than 5°, after exposure to radiation in the photoabsorption band of the material for a time period and at an intensity to render the material photoactive. As will be appreciated by one skilled in the art, while photohydrophilic coatings are hydrophilic (i.e., water wetting), not all hydrophilic coatings are necessarily photohydrophilic (i.e., produce a decrease in water droplet contact angle as a result of exposure to certain electromagnetic energy). Also, even if photoactive, the coating 24 may not necessarily be photocatalytic to the extent that it is self-cleaning, i.e., may not be sufficiently photocatalytic to decompose organic materials like grime on the coating surface in a reasonable or economically useful period of time, but could still be photohydrophilic.

The coating material of the coating 24 can include at least one metal oxide, such as but not limited to one or more metal oxides or semiconductor metal oxides, such as oxides of titanium, silicon (e.g., silica), aluminum, iron, silver, cobalt, chromium, copper, tungsten, tin, vanadium, or zinc, or mixed oxides such as zinc/tin oxides (such as zinc stannate), strontium titanate, and mixtures containing any one or more of the above. The metal oxide can be crystalline or at least partially crystalline. In one exemplary coating 24, the coating material can be all or at least partly titanium dioxide. In another exemplary coating, the coating material can be all or at least partly silica. Examples of suitable coatings 24 are found in (but are not limited to) U.S. patent application Ser. Nos. 10/007,382; 10/075,996; 10/133,805; 10/397,001; 10/422,095; 10/422,095; 10/422,096; 60/305,191; and 60/305,057. It is to be understood that the coating 24 is not limited to metal oxides but could include one or more nitrides, carbides, or mixtures or combinations thereof, such as but not limited to one or more metal nitrides, metal carbides, metal oxides, or mixtures thereof. Another exemplary coating that can be utilized in the practice of the invention is the coating utilized on the commercially available coated glass sold under the trade name ACTIVT by Pilkington plc Corporation of Great Britain.

The coating 24 can be of any desired thickness and can be hydrophilic and/or photoactive (such as photocatalytic and/or photoactively hydrophilic, or both). As a general rule, the thickness of the coating 24 to achieve photoactive hydrophilicity can be much less than is needed to achieve a commercially acceptable level of photocatalytic self-cleaning activity. For example, in one embodiment, the coating 24 can have a thickness of 10 Å to 5000 Å, where thicker coatings in this range can have photocatalytic self-cleaning activity for at least some period of time as well as hydrophilicity. As the coatings get thinner in this range, photocatalytic self-cleaning activity typically decreases in relation to performance and/or duration. As coating thickness decreases in such ranges as 50 Å to 3000 Å, e.g., 100 Å to 1000 Å, e.g., 200 Å to 600 Å, e.g., 200 Å to 300 Å, photocatalytic self-cleaning activity may be unmeasurable but photoactive hydrophilicity can still be present in the presence of selected electromagnetic radiation, e.g., within the photoabsorption band of the material.

In one non-limiting embodiment, the coating 24, in particular the top or outer surface 26 of the coating, can have a root mean square (RMS) surface roughness of less than 5 nm even for thin coatings in the above ranges, such as 200 Å to 300 Å, e.g., less than 4.9 nm, e.g., less than 4 nm, e.g., less than 3 nm, e.g., less than 2 nm, e.g., less than 1 nm, e.g., 0.3 nm to 0.7 nm.

The coating 24 can be deposited directly on, i.e., in surface contact with, the surface 14 of the substrate 12 as shown in FIG. 1. Alternatively, one or more other layers or coatings can be interposed between the coating 24 and the substrate 12. For example, the coating 24 can be an outer or the outermost layer of a multilayer coating stack or the coating 24 may be embedded as one of the layers other than the outermost layer within such a multilayer coating stack. By "an outer layer" is meant a layer receiving sufficient exciting electromagnetic radiation, e.g., radiation within the photoabsorption band of the layer material, to provide the coating 24 with sufficient photoactivity to be at least photoactively hydrophilic if not necessarily photocatalytic. In one non-limiting embodiment, the article can be a piece of ACTIV™ glass commercially available from Pilkington plc Corporation of Great Britain.

In one embodiment, the coating 24 can be or can include a diamond-like carbon (DLC) inclusive protective material or layer (e.g., including at least one highly tetrahedral amorphous carbon (ta—C) inclusive layer having $sp^3$ carbon-carbon bonds) for example to enhance the scratch resistance, abrasion resistance, and general mechanical durability of the coated article or any underlying coatings. The DLC layer can be hydrophobic, hydrophilic, or neutral in different embodiments of the invention. In one embodiment but not limiting to the invention, the DLC layer can be or can include any of the DLC layers described and/or illustrated in U.S. Pat. No. 6,261,693 or U.S. Pat. No. 6,338,901. The DLC layer can include at least some amount of highly tetrahedral amorphous carbon (ta—C). Highly tetrahedral amorphous carbon (ta—C) forms $sp^3$ carbon-carbon bonds, and is a special form of diamond-like carbon (DLC). In one non-limiting embodiment, at least about 40% (such as at least about 60%, e.g., such as at least about 80%) of the carbon-carbon bonds in DLC layer can be of the $sp^3$ carbon-carbon type. The remainder of the bonds in the DLC layer can be, for example, $sp^2$ carbon-carbon bonds, Si—C bonds, C—O bonds, or the like. The provision of at least some $sp^3$ carbon-carbon bonds in the DLC layer enables the DLC layer to be more scratch resistant, hard, chemically resistant, and substantially transparent. The DLC layer, in certain embodiments, can have a hardness of at least about 10 GPa, such as in the range of about 25-80 GPa, due in large part to the presence of the $sp^3$ carbon-carbon bonds.

As shown in FIG. 1, in addition to the coating 24, one or more functional coatings 28 can be deposited on or over at least a portion of the substrate 12, e.g., on or over at least a portion of one or both of the major surfaces 14 and 16. For example, a functional coating 28 can be deposited over the second major surface 16 of the substrate 12 that is opposite the first major surface 14 or between the coating 24 and the substrate 12. As used herein, the term "functional coating" refers to a coating that modifies one or more physical properties of the substrate on which it is deposited, e.g., optical, thermal, chemical or mechanical properties, and is not intended to be removed from the substrate during subsequent processing. The functional coating 28 can have one or more functional coating films of the same or different composition or functionality. As used herein, the terms "layer" or "film" refer to a coating region of a desired or selected coating composition.

For example, the functional coating 28 can be an electrically conductive coating, such as, for example, an electrically conductive heated window coating as disclosed in U.S. Pat. Nos. 5,653,903 and 5,028,759, or a single-film or multi-film coating capable of functioning as an antenna. Likewise, the functional coating 28 can be a solar control coating, for example, a visible, infrared or ultraviolet energy reflecting or absorbing coating. Examples of suitable solar control coatings are found, for example, in U.S. Pat. Nos. 4,898,789; 5,821,001; 4,716,086; 4,610,771; 4,902,580; 4,716,086; 4,806,220; 4,898,790; 4,834,857; 4,948,677; 5,059,295; and 5,028,759, and also in U.S. patent application Ser. No. 09/058,440. Similarly, the functional coating 28 can be a low emissivity coating. "Low emissivity coatings" allow visible wavelength energy to be transmitted through the coating but reflect longer-wavelength solar infrared energy and/or thermal infrared energy and are typically intended to improve the thermal insulating properties of architectural glazings. By "low emissivity" is meant emissivity less than 0.4, such as less than 0.3, such as less than 0.2. Non-limiting examples of low emissivity coatings are found, for example, in U.S. Pat. Nos. 4,952,423 and 4,504,109 and British reference GB 2,302,102. The functional coating 28 can be a single layer or multiple layer coating and can comprise one or more metals, non-metals, semi-metals, semiconductors, and/or alloys, compounds, composites, combinations, or blends thereof. For example, the functional coating 28 can be a single layer metal oxide coating, a multiple layer metal oxide coating, a non-metal oxide coating, or a multiple layer coating.

Examples of suitable functional coatings are commercially available from PPG Industries, Inc. of Pittsburgh, Pa. under the SUNGATE® and SOLARBAN® families of coatings. Such functional coatings typically include one or more anti-reflective coating films comprising dielectric or anti-reflective materials, such as metal oxides or oxides of metal alloys, which can be transparent or substantially transparent to visible light. The functional coating 28 can also include infrared reflective films comprising a reflective metal, e.g., a noble metal such as gold, copper or silver, or combinations or alloys thereof, and may further comprise a primer film or barrier film, such as titanium, as is known in the art, located over and/or under the metal reflective layer.

As mentioned above, a problem in cleaning photoactive surfaces is that while these surfaces can decompose organic material, they typically have little or no effect in degrading inorganic materials. Therefore, if an article 10 having a photoactive surface, e.g., such as a coating 24, is rinsed or washed with conventional tap water, inorganic materials in the tap water (such as calcium, magnesium, iron, chlorine, sodium, silicates, etc.) are not photocatalytically decomposed and tend to remain on the surface. For hydrophilic and/or photoactive surfaces, the sheeting action of the hydrophilic and/or photoactive surfaces, e.g., coatings, in some cases can allow dirt or inorganic materials to spread out unevenly on the surface to form visually discernable streaks or patterns on the substrate 12. These streaks or patterns are aesthetically displeasing and can make the glass appear hazy or dirty. Moreover, deposited silicates can chemically bond with exposed portions of the glass substrate 12 and, over time, can cause the glass substrate 12 to become hazy.

Therefore, in one practice of the invention to clean a substrate 12 having a hydrophilic and/or photoactive surface, e.g., a coating 24, the coated substrate 12 can be rinsed with conditioned water to flush at least some of the dirt, grime, organic materials, and/or inorganic materials off of the hydrophilic and/or photoactive, e.g., coated, surface. As used herein, the term "conditioned water" refers to water being low in dissolved minerals and/or inorganic materials. In one practice of the invention, the conditioned water can be formed by removing at least some of the dissolved minerals and/or inorganic materials, such as dissolved inorganic ions, from non-conditioned water. By "low in dissolved minerals and/or inorganic materials" is meant that the conditioned water is sufficiently low in dissolved materials (e.g., minerals and/or inorganics) such that the specific conductance of the conditioned water is less than or equal to 200 micro-ohms ($\mu\Omega^{-1}$), such as less than or equal to 150 $\mu\Omega^{-1}$, such as less than or equal to 100 $\mu\Omega^{-1}$, such as less than or equal to 80 $\mu\Omega^{-1}$, such as less than or equal to 60 $\mu\Omega^{-1}$, such as less than or equal to 50 $\mu\Omega^{-1}$, such as in the range of 0 $\mu\Omega^{-1}$ to 200 $\mu\Omega^{-1}$. By "non-conditioned water" is meant water having a conductance of greater than 200 $\mu\Omega^{-1}$. By using conditioned water to rinse the hydrophilic and/or photoactive surface, loose inorganic materials and broken down organic materials on the surface, e.g., the coating 24, can be rinsed off but little or no additional inorganic materials are deposited onto the article 10 which could impact on the transparency, visible light transmittance, or aesthetic appearance of the article 10.

Figure 2:
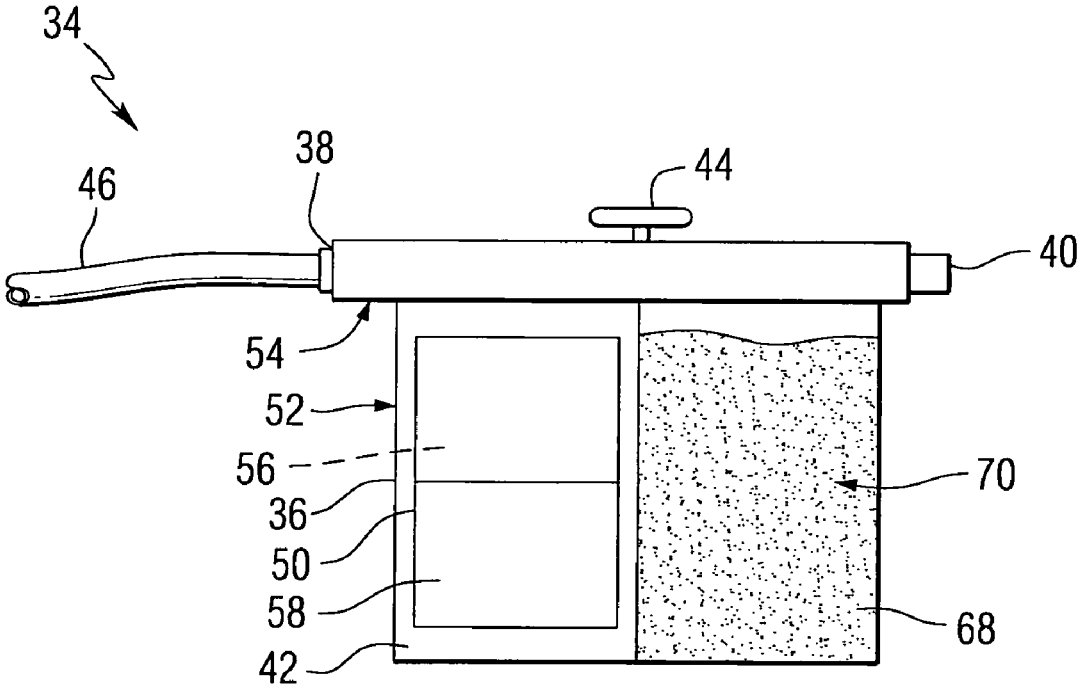
FIG. 2 is a side, schematic view (not to scale) of a cleaning device incorporating features of the invention.

The conditioned water can be obtained by any desired method. For example, one could purchase conditioned water, such as deionized or distilled water, from a commercial retail store. However, in one aspect of the invention, the conditioned water can be obtained by utilizing a cleaning assembly of the invention to treat non-conditioned water. An exemplary cleaning assembly 34 is shown in FIG. 2. The cleaning assembly 34 includes a housing 36 having an inlet 38 and an outlet 40. The outlet 40 can be located any distance from the housing 36. A flow passage extends through the housing 36 between the inlet 38 and the outlet 40. By "flow passage" is meant a flow path through the housing 36 through which non-conditioned and/or conditioned water can be selectively channeled. The housing 36 can be of any conventional materials, such as metal or plastic, and can be of any desired dimensions. At least one chamber, such as a first chamber 42, can be located in the housing 36. The cleaning assembly 34 can also include a conventional selector valve 44 to adjust or change the flow path of a fluid (e.g., conditioned and/or non-conditioned water) through the cleaning assembly 34. For example, a conventional water hose 46 can be connectable with the housing 36 in any conventional manner, such as by threads. The selector valve 44 can be moved to selectively place the housing flow passage in flow communication with the first chamber 42 (and then to the outlet 40) or directly to the outlet 40 (bypassing the first chamber 42) to selectively direct water from the hose 46 either through the first chamber 42 or to the outlet 40 without going through the first chamber 42. The structure and operation of such selectively directionable conventional housing/valve assemblies will be well understood by one of ordinary skill in the art and, hence, will not be described in detail. One exemplary but non-limiting example of such a device is disclosed in U.S. Pat. No. 5,039,016.

In one embodiment, an ion exchange bed 50 can be positioned, e.g., removably positioned, in the housing 36, e.g., removably placed in the first chamber 42. The ion exchange bed 50 can be a conventional ion exchange cartridge. For example, a bottom (first) portion 52 of the housing 36 can be removably attached to an upper (second) housing portion 54. For example, the bottom portion 52 can threadably engage and disengage the top portion 54 of the housing 36 such that the bottom portion 52 of the housing 36 can be removed and the ion exchange bed 50, such as a resin bed or conventional ion exchange cartridge, inserted into or removed from the first chamber 42. After insertion or exchange of the ion exchange bed 50, the bottom portion 52 can be reattached to the upper portion 54. The ion exchange bed 50 can be a multi-bed exchange column or a mixed resin bed. In a multi-bed exchange column, two or more separate resin beds are located in the cartridge and, when the selector valve 44 is positioned to direct water through the ion exchange bed 50, the water flows first through one bed 56 (e.g., an upper or first bed) and then another bed 58 (e.g., a lower or second bed) before being directed to the outlet 40. Alternatively, the housing 36 can be constructed with channels or passages such that the water is introduced into the lower bed 58 and then flows upwardly through the upper bed 56. The ion exchange bed 50, for example one of the beds 56, 58, can include one or more conventional resin materials to replace cations, such as sodium ions, calcium ions, and/or magnesium ions, with hydrogen ions. Examples of such suitable resin materials include sulfonic acid-containing materials, such as polystyrene divinyl benzene having sulfonic acid groups. Additionally or alternatively, the ion exchange bed 50, for example the second resin bed 58, can include one or more materials to replace anions in the water, such as silicates and/or chlorine, with hydroxyl ions. Examples of such materials include ammonium-containing materials, such as organic quaternary ammonium hydroxides (e.g., tetramethyl ammonium hydroxide), aliphatic quaternary ammonium hydroxides (e.g., tetraalkyl ammonium hydroxides), or polystyrene divinyl benzene having quaternary ammonium groups. In a mixed bed, these two types of ion exchange or resin materials can be mixed together rather than being present in separate beds.

Cation and anion exchange resins useful in the process include polystyrene crosslinked with (divinyl)benzene (DVB) matrix-based resins, such as Rohm and Haas ion exchange resins, sold under the trade name "Amberlite" and Bayer AG resins sold under the trade name "Lewatit". An exemplary cation exchange resin is Amberlite-120 Plus resin (hydrogen form, a strong acid type). Examples of anion exchange resins include a strongly basic resin such as Amberlite IRN-78 resin (hydroxide-form; a quaternary ammonium divinyl benzene (DVB)/styrene co-polymer) and Amberlite IRA 400 resin (a quaternary ammonium hydroxide).

In one embodiment, weak acid cation exchange resins having —COOH as the active group and weak base anion exchange resins carrying quaternary/tertiary amine functionality attached to styrene-DVB polymers can be used. Examples of weak anion exchange resins include Amberlite IRA-99 resin, IRA-96 resin, and Lewatit MP64 resin which are based on tertiary amino groups attached to a copolymer of styrene-DVB matrix.

In one non-limiting embodiment, chelating cation exchange resins can be used. For example, suitable exchange materials are disclosed by "Samuelson, Ion Exchange Separation Analytical Chemistry", John Wiley and Sons, New York, 1963, pp. 33, 69, 87, and 88, and in the Meyers, Encyclopedia of Physical Science and Technology, Second Edition, Harcourt Brace Jovanovich, San Diego, 1992, Volume 3, pp. 363 to 367. Exemplary chelating exchange resins can include polyamines on polystyrene, polyacrylic acid or polyethylene-imine backbones; thiourea on polystyrene backbones; quinoline on polystyrene backbones; dithiocarbamate on a polyethylene-imine backbone; hydroxamic acid on a polyacrylate backbone; hydroxamic acid on a (methy)acrylate-divinyl benzene copolymer, mercapto on polystyrene backbones; and cyclic polyamines on polyaddition and polycondensation resins. Further exemplary chelating exchange resins can include styrene-divinylbenzene copolymers having iminodiacetate groups where two carboxyl groups and the tertiary nitrogen give the resin a chelating capability. Such resins are commercially available as Dow Chelex 100 resin and Dowex A-1 resin, both available from Dow Chemical Company; Diaion CR-10 resin available from Mitsubishi; Unicellex UR-10 resin available from Unitica Chemical; Lewatit TP 207 resin available from Bayer Corporation; and Amberlite IRC-718 resin commercially available from Rohm and Haas Company. The chelating cation exchange resins can be provided in sodium salt form. If desired, the sodium ion can be removed from the resin prior to its use to prevent sodium from entering the solution treated with the resin. This can be accomplished by rinsing the resin with a strong acid, such as but not limited to mineral acids, hydrochloric acid, nitric acid, or sulfuric acid.

Exemplary strong anion exchange resins useful for the invention can be based upon copolymers of styrene and divinyl benzene which have been chloromethylated and then aminated. The aminated resin can be used to form a quaternary ammonium functional group. Weak base anion exchange resins can also be formed from styrene-divinyl benzene copolymers which are chloromethylated and aminated in a two-step process. Chloromethyl groups can be attached to the aromatic rings by reaction of a compound, such as chloromethyl ether, with the copolymer in the presence of a Friedel-Crafts catalyst, such as aluminum chloride. Functionalization can be completed by aminating the chloromethylated copolymer with either a primary or secondary amine. Ion exchange resins of the type described are well known in the art and described in numerous publications, including "Kirk-Othrner, Encyclopedia of Chemical Technology", Volume 14, (Fourth Edition), 1995, pp. 737-783, especially pp. 737-749. Suitable anion exchange resins include Amberlite IRA-904 resin which is a styrene-divinyl benzene resin having quaternary ammonium chloride substitution, Amberlite IRA-958 resin which is an acrylic-divinyl benzene resin having quaternary ammonium chloride substitution, and Duolite A-191 resin and Duolite A-192 resin, both of which are styrene-divinyl benzene resins having quaternary ammonium chloride substitution.

In one embodiment, to form conditioned water the selector valve 44 can be positioned to direct non-conditioned water from the hose 46 through the ion exchange bed 50 and then out of the outlet 40. The pressure of water discharged from the outlet 40 can be at a pressure less than that which would break or damage the coated article 10, which could be a window or part of a window, for example. In one embodiment, the water through the ion exchange bed 50 can have a discharge flow rate in the range of 0.3 gallons per minute to 0.5 gallons per minute (1.1 liters per minute to 1.9 liters per minute). This flow rate is particularly useful for spray applications. For use with conventional water-fed poles, the discharge flow rate can be different than that for spray applications. For example, in one embodiment the flow rate for use with water-fed poles can be 0.08 gallon per minute to 0.13 gallon per minute (0.3 liter per minute to 0.5 liter per minute).

In another embodiment of the invention, prior to contacting the article 10 with conditioned water, the article 10 can be contacted with a cleaning solution or dispersion having at least one cleaning agent. As used herein, the term "cleaning agent" refers to a material comprising at least one surfactant and/or at least one complexing agent. The cleaning solution or dispersion can be made with non-conditioned water. Alternatively, in one embodiment and as shown in FIG. 2, the cleaning assembly 34 can include the first chamber 42 and at least one other chamber, such as a second chamber 68. The selector valve 44 can be positioned to direct water through the first chamber 42, the second chamber 68, neither chamber, or both chambers 42, 68. In this embodiment, the first chamber 42 can include a removable ion exchange bed 50, such as that described above. The second chamber 68 can include a cleaning agent 70 which can be applied onto the coated article 10 either before or after application of the conditioned water. For example, the cleaning agent 70 can include a water-dispersible or water-soluble surfactant and the flow rate of water through the second chamber 68 can be such to provide a surfactant solution or dispersion out of the outlet 40 having a desired surfactant concentration. In one non-limiting embodiment, the discharged surfactant solution or dispersion can have a surfactant concentration in the range of 0.001 weight percent to 0.05 weight percent surfactant. Contacting the photoactive and/or hydrophilic surface of the article 10 with the surfactant solution allows the surfactant to wet out hydrophobic areas on the surface, which can decrease streaking or patterning by reducing or eliminating hydrophobic areas that can act as accumulation sites for the accumulation of inorganic materials.

Suitable surfactants for the practice of the invention include anionic, cationic, amphoteric, and non-ionic surfactants. Exemplary amphoteric surfactants include Miranol surfactant (disodium cocoamphodiacetate). Another useful class of amphoteric surfactants are exemplified by cocoamidopropyl betaine commercially available under the trade name Amphoso CA. Poloxamine, poloxamers, and tyloxapol are examples of non-ionic surfactants having one or more poly (oxyalkylene) chains. Such surfactants are available from BASF Wyandotte Corp., Wyandotte, Mich., under the names "Pluronic" or "Tetronic". Examples of suitable poloxamers are Pluronic F108, F88, F68, F68LF, F127, F87, F77, P85, P75, P104, and P84 surfactants. Examples of suitable poloxamines are Tetronic 707, 1107, and 1307 surfactants. Other non-ionic surfactants include polyethylene glycol esters of fatty acids, e.g., coconut, polysorbate, polyoxyethylene or polyoxypropylene ethers of higher alkanes (C12-C18). Examples include Tween 20 (polysorbate) and Tween 80 (polyoxyethylene) surfactants, lauryl ether, polyoxyethylene stearate, and polyoxyethylene propylene glycol stearate (Atlas G 2612 surfactant). Exemplary surfactants suitable for use in the invention can be readily ascertained, but are not limited to, those described in "McCutcheon's Detergents and Emulsifiers", North American Edition, McCutcheon Division, MC Publishing Co., Glen Rock, N.J. 07452 and the "CTFA International Cosmetic Ingredient Handbook", published by The Cosmetic, Toiletry, and Fragrance Association, Washington, D.C.

Alternatively or additionally thereto, the cleaning agent 70 can include a complexing agent which can form a complex compound or coordination compound with metal ions, such as transition metal ions, in the water. As will be appreciated by one skilled in the art, a coordination compound can be formed by the union of a metal ion with a non-metallic ion or molecule (the complexing agent). The complexing agent can be positively charged, negatively charged, or neutral or can be a molecule of water or ammonia. The complexing agent or "ligand" can be a charged or neutral molecule that can attach to the central atom of a coordination compound to form a chelate, or other complex. A chelate is a particular type of coordination compound in which the central metal ion is attached by coordinate links to two or more non-metal atoms or electron donating groups in the same molecule. Suitable complexing agents for the practice of the invention include, but are not limited to, acids, such as amino acids or carboxylic acids or their salts (e.g., ammonium salts or sodium salts), such as but not limited to glycolic acid, oxalic acid, alkyldiaminetetraacetic acids, such as but not limited to ethylenediaminetetraacetic acid (EDTA) or their salts. Other suitable complexing agents include oxoacids of sulfur (such as but not limited to sulfamic acid and sulfuric acid), citric acid, acetic acid, oxoacids of phosphorous (examples of oxoacids of phosphorous or esters thereof include phosphoric and phosphorous acids, and esters thereof, such as phosphoric acid, phosphorous acid, di(n-butyl) phosphate and diphenyl phosphate, phosphonic acid, and esters thereof, such as phosphonic acid, dimethyl phosphonate, di(n-butyl) phosphonate, phenyl phosphonate, diphenyl phosphonate, and dibenzyl phosphonate and phosphinic acid, and esters thereof, such as phosphinic acid and phenyl phosphinate; esters of these phosphorus-containing acids can include monomethyl, monophenyl, monobenzyl, dimethyl, di-n-butyl, diphenyl and dibenzyl esters of the acids, e.g., phenyl phosphonate; hydroxyethylidene diphosphonic acid commercially available under the tradename DEQUEST 2010 from Solutia Inc. of St. Louis, Miss.) and their salts, for example ammonium salts or sodium salts (such as but not limited to trisodium phosphate) or esters of phosphorous-containing oxoacids; or mixtures of acids and salts (such as but not limited to diethylenetriamine penta-methylenephosphonic acid pentasodium salt commercially available under the tradename DEQUEST 2066 from Solutia Inc. of St. Louis, Miss.); sugars, such as but not limited to sucrose, glucose, fructose, and the like; or any mixtures containing any one or more of the above.

Examples of other complexing agents include diphosphate, triphosphate, phosphonate, citrate, nitrilotriacetic acid (NTA), alkyl- or alkenyl-succinic acid, organic acids having more than one carboxyl group including citric acid, tartaric acid, oxalic acid, succinic acid, and malonic acid. Still further examples of complexing agents include lactic acid, sulphosalicylates., acetylacetonate, compounds of boric acid, phosphoric acid, and covalently or coordinatively bonded metals, such as zinc, aluminium or copper. Additional complexing agents include trans-1,2-diaminocyclohexanetetraacetic acid (CyDTA), diethylenetriaminepentaacetic acid (EDPA) and triethylenetetraaminehexaacetic acid (TTHA), imino phosphonic acids such as ethylenediaminetetrakis (methylenephosphonic acid) (EDTPO), nitrilotris (methylenephosphonic acid) (NTPO) and propylenediamine tetra (methylenephosphonic acid) (PDTMP), and carboxylic acids such as formic acid, and the like, or mixtures or combinations containing one or more of the foregoing. The complexing agents can include electron-donating groups that allow them to attach (by coordination links, e.g., solvate or covalent bonds) to the central atom of the coordination compound. The formation of coordination compounds with metal ions in the water is believed to reduce light scattering on the surface of the article 10 since the coordination compounds are typically smaller than would be the inorganic crystals formed without the presence of the complexing agent. Additionally, the coordination compounds are believed to be either more evenly distributed across the surface of the coated article or reduced in amount and, therefore, less objectionable in appearance. This more uniform distribution can make the article look cleaner than a similar article having a non-uniform distribution of materials, e.g., streaks or patterns.

In addition to the cleaning agent 70, the second and/or first chambers 68, 42 can also include a fragrance material.

In one embodiment, the cleaning solution can have a pH in the range of about 1 to 12, such as in the range of about 5 to about 11, such as in the range of about 6 to about 10, such as in the range of about 6 to about 8, such as in the range of about 7.5 to about 8.5.

In a further embodiment of the invention, prior to application of the cleaning agent solution and/or the conditioned water, the surface of the coated article 10 can be contacted with a hydrofluoric acid-containing cleaner to assist in removing silicates, such as those that may have been previously bonded to the glass surface.

In a still further embodiment, the surface of the coated article 10 can be contacted with a cleaning agent solution or dispersion made from conditioned water. In this embodiment, conditioned water can be directed through a cleaning agent source (such as a source of a surfactant and/or a completing agent) to form a cleaning agent solution or dispersion (i.e., cleaning agent liquid). This solution or dispersion can be directed onto the surface to be cleaned and then subsequently rinsed off with conditioned water. Alternatively, the cleaning agent solution or dispersion made with conditioned water can be applied to the surface to be cleaned and can simply be allowed to dry without subsequent rinsing of the surface with conditioned water. Alternatively, a cleaning agent liquid (e.g., solution or dispersion) can be made with non-conditioned water and can be applied onto the surface to be cleaned to wash away dirt and grime. After which, the cleaning agent liquid can be rinsed off of the surface with conditioned water.

Operation of the second embodiment of the cleaning assembly 34 will now be described. The bottom portion 52 of the housing 36 can be disengaged, such as by unscrewing the bottom portion 52 from the upper portion 54. A commercially available ion exchange bed 50 can be placed in the first chamber 42 and cleaning agent 70 (containing a surfactant source and/or a complexing agent source) can be placed in the second chamber 68. The bottom portion 52 can be reengaged with the upper portion 54. A hose 46 (in flow communication with a source of water, e.g., non-conditioned water) can be attached, e.g., threadably attached, to the inlet 38. In order to clean an article 10 having a photoactive and/or hydrophilic surface, the water for the hose 46 can be turned on and the outlet 40 of the cleaning assembly 34 pointed towards the surface to be cleaned to wash the surface with conventional tap water (non-conditioned water). However, in one practice of the invention, the tap water is not permitted to dry on the surface, which could tend to leave inorganic materials as described above. Rather, after flushing the surface with the tap water to remove accumulated grit or grime, the selector valve 44 can be positioned to direct the flow of non-conditioned water from the hose 46 through the first chamber 42 and then through the outlet 40. As the water flows through the first chamber 42, the ion exchange bed 50 removes at least a portion of the inorganic materials, such as inorganic ions, from the water such that conditioned water leaves the first chamber 42 and flows out of the outlet 40. This conditioned water can be used to rinse away the previous conventional tap water to prevent the accumulation of inorganic materials on the surface.

Alternatively, in another embodiment after optionally rinsing the surface with conventional tap water, the selector valve 44 can be positioned to direct the flow of non-conditioned water from the hose 46 through the second chamber 68 containing the cleaning agent 70 (thus bypassing the first chamber 42). As the non-conditioned water flows through the second chamber 68, the cleaning agent 70 is solubilized or dispersed to provide a cleaning agent solution or dispersion (cleaning agent liquid) out of the outlet 40. This cleaning agent solution can be directed towards the surface to rinse inorganic materials from the surface. After rinsing the surface with the cleaning agent solution, the selector valve 44 can be moved to stop the flow of water into the second chamber 68 and start the flow of water into the first chamber 42 to form conditioned water. As the water flows through the first chamber 42 (bypassing the second chamber 68), the ion exchange bed 50 removes at least some of the inorganic ions to provide conditioned water out of the outlet 40. This conditioned water can then be used to rinse away the previously applied cleaning agent solution. In the exemplary methods described above, the final step in cleaning the surface was the application of conditioned water. In the practice of the invention, the use of conditioned water to rinse away any previously applied conventional tap water and/or cleaning solution helps minimize the accumulation of inorganic materials on the surface to prevent inorganic material buildup which could adversely impact the transparency of the article 10.

In a still further embodiment, non-conditioned water can be directed through the first chamber 42 to form conditioned water. This conditioned water can then be directed through the second chamber 68 to form a cleaning agent liquid (e.g., solution or dispersion) made with conditioned water. This cleaning agent liquid can be applied onto the surface to be cleaned to rinse away dirt and grime. After which, the cleaning agent liquid on the surface can simply be allowed to dry. Optionally, the cleaning agent liquid can be rinsed off of the surface with conditioned water by moving the selector valve 44 to direct non-conditioned water through the first chamber 42 and then to the outlet 40 (bypassing the second chamber 68).

In an alternative embodiment, prior to contacting the surface with conventional tap water and/or the cleaning agent solution and/or conditioned water, the surface can be contacted with a conventional cleaning solution containing hydrofluoric acid to remove at least some of the silicates and similarly bonded materials from the surface.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A method of cleaning a photoactive and/or hydrophilic surface, comprising:

contacting a photoactive and/or hydrophilic surface with a cleaning agent solution, wherein the cleaning agent solution consists essentially of a surfactant and a complexing agent, and contacting the surface with conditioned water.

2. The method of claim 1, wherein the conditioned water has a specific conductance of less than or equal to 200 microohms.

3. The method of claim 1, wherein the conditioned water is obtained by:

conducting non-conditioned water through an ion exchange bed.

4. The method of claim 3, wherein the ion exchange bed is a multi-bed exchange column.

5. The method of claim 3, wherein the ion exchange bed is a mixed resin bed.

6. The method of claim 3, including adding a fragrance to the conditioned water.

7. The method of claim 1, wherein the contacting step is practiced by spraying conditioned water onto the surface.

8. The method of claim 1, wherein the contacting step is practiced by conducting the conditioned water through a water-fed pole onto the surface.

9. The method of claim 1, wherein the conditioned water is obtained by:

connecting a cleaning assembly to a source of non-conditioned water comprising inorganic material, the cleaning assembly comprising an ion exchange bed; and selectively conducting the non-conditioned water through the ion exchange bed to remove at least some of the inorganic material.

10. The method of claim 9, wherein the cleaning assembly includes:

a housing; and an ion exchange bed removably held in the housing.

11. The method of claim 1, wherein the cleaning agent solution is obtained by:

connecting a cleaning assembly to a water source, the cleaning assembly including a cleaning agent comprising at least one of a surfactant and a complexing agent; and selectively conducting conditioned water through the cleaning agent to provide the cleaning agent solution.

12. The method of claim 11, wherein the cleaning assembly includes a housing removably connected to the water source.

13. The method of claim 1, wherein the complexing agent includes at least one material selected from amino acids, carboxylic acids, alkyldiaminetetraacetic acids, oxoacids of phosphorous, oxoacids of sulfur, salts of any of the above, sugars, and any mixtures containing any one or more of the above.

* * * * *